US011319826B2

(12) United States Patent
Dominka et al.

(10) Patent No.: US 11,319,826 B2
(45) Date of Patent: May 3, 2022

(54) SEAL SEGMENT FOR A TURBINE, ASSEMBLY FOR EXTERNALLY DELIMITING A FLOW PATH OF A TURBINE, AND STATOR/ROTOR SEAL

(71) Applicant: Siemens Energy Global GmbH & Co. KG, Munich (DE)

(72) Inventors: Oliver Dominka, Oranienburg (DE); Ole Geisen, Berlin (DE); Marian Gollmer, Berlin (DE); David Rule, Berlin (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 599 days.

(21) Appl. No.: 16/325,816

(22) PCT Filed: Aug. 8, 2017

(86) PCT No.: PCT/EP2017/070030
§ 371 (c)(1),
(2) Date: Feb. 15, 2019

(87) PCT Pub. No.: WO2018/041555
PCT Pub. Date: Mar. 8, 2018

(65) Prior Publication Data

US 2021/0332712 A1 Oct. 28, 2021

(30) Foreign Application Priority Data

Aug. 31, 2016 (EP) ..... 16186537

(51) Int. Cl.
*F01D 11/08* (2006.01)
*F01D 9/04* (2006.01)
*F01D 25/24* (2006.01)

(52) U.S. Cl.
CPC ..... *F01D 11/08* (2013.01); *F01D 9/04* (2013.01); *F01D 25/24* (2013.01);
(Continued)

(58) Field of Classification Search
CPC . F01D 9/00; F01D 9/04; F01D 11/005; F01D 11/08; F01D 11/12; F01D 11/122;
(Continued)

(56) References Cited

U.S. PATENT DOCUMENTS 5,941,685 A * 8/1999 Bagepalli ..... F01D 5/225 415/173.3
8,206,092 B2 * 6/2012 Tholen ..... F01D 11/08 415/173.1
11,131,204 B2 * 9/2021 Notarnicola ..... B29C 64/153
2009/0238683 A1 9/2009 Alvanos et al.
(Continued)

FOREIGN PATENT DOCUMENTS

CN 2672289 Y 1/2005
CN 101970804 A 2/2011
(Continued)

OTHER PUBLICATIONS

PCT International Search Report and Written Opinion of International Searching Authority dated Oct. 11, 2017 corresponding to PCT International Application No. PCT/EP2017/070030filed Aug. 8, 2017.

*Primary Examiner* — Eldon T Brockman
*Assistant Examiner* — Danielle M. Christensen

(57) ABSTRACT

A seal segment for a turbine and an assembly for sealing the gaps between seal segments and stator vanes of a turbine. The seal segments have a plate-shaped wall, the first lateral surface of which faces the vane tips in the assembled state of the seal segments, is surrounded by a closed circumferential edge, and can be divided into four lateral wall sections, and the plate-shaped wall has a seal element which is arranged over the entire surface of the lateral surface. A
(Continued)

number of seal lamellae which are secured on one side are provided on at least one of the lateral wall sections and/or on at least one of the seal lateral wall sections facing adjacent seal segments when the seal segments are assembled in a turbine so as to form a ring in order to reduce a flow along the corresponding lateral wall section.

10 Claims, 2 Drawing Sheets

(52) U.S. Cl.
CPC ..... *F05D 2220/32* (2013.01); *F05D 2240/11* (2013.01); *F05D 2240/55* (2013.01); *F05D 2240/59* (2013.01); *F05D 2250/283* (2013.01)

(58) Field of Classification Search
CPC .... F01D 11/127; F01D 25/24; F05D 2220/32; F05D 2240/11; F05D 2240/14; F05D 2240/55; F05D 2240/56; F05D 2240/59; F05D 2250/283
See application file for complete search history.

(56) References Cited

U.S. PATENT DOCUMENTS

| | | | | |
|---|---|---|---|---|
| 2011/0052380 | A1 | 3/2011 | Bariaud et al. | |
| 2012/0126485 | A1* | 5/2012 | Fairbourn | F01D 11/127 277/414 |
| 2014/0271142 | A1 | 9/2014 | Albers et al. | |
| 2014/0328672 | A1* | 11/2014 | Brandl | F01D 9/04 415/139 |
| 2015/0118035 | A1 | 4/2015 | Gendraud et al. | |
| 2019/0040758 | A1 | 2/2019 | Quennehen et al. | |

FOREIGN PATENT DOCUMENTS

| | | | |
|---|---|---|---|
| CN | 104246141 | A | 12/2014 |
| CN | 105189934 | A | 12/2015 |
| CN | 108138576 | A | 6/2018 |
| DE | 102013205883 | A1 | 10/2014 |
| EP | 2620598 | A2 | 7/2013 |
| EP | 2787177 | A1 | 10/2014 |
| GB | 2481481 | A | 12/2011 |
| JP | 2004353629 | A | 12/2004 |
| WO | 2008033897 | A1 | 3/2008 |
| WO | 2014193509 | A2 | 12/2014 |

* cited by examiner

SEAL SEGMENT FOR A TURBINE, ASSEMBLY FOR EXTERNALLY DELIMITING A FLOW PATH OF A TURBINE, AND STATOR/ROTOR SEAL

CROSS REFERENCE TO RELATED APPLICATIONS

This application is the US National Stage of International Application No. PCT/EP2017/070030 filed Aug. 8, 2017, and claims the benefit thereof. The International Application claims the benefit of European Application No. EP16186537 filed Aug. 31, 2016. All of the applications are incorporated by reference herein in their entirety.

FIELD OF INVENTION

The invention relates to a sealing segment, to an arrangement for outwardly delimiting a flow path of a turbine, and to a stator-rotor seal.

BACKGROUND OF INVENTION

For gas turbines, it is well known that, within the turbine unit, the flow path is delimited radially outwardly inter alia with the aid of elements which are able to be assembled to form a ring. Said elements are commonly known as ring segments which extend over a certain arc length of the flow channel, which is annular as seen in cross section. In a known way, the ring segments are hooked onto a carrier, normally onto the turbine guide vane carrier, via one or more hook-type connections such that their inwardly facing surface faces the tips, passing below, of rotor blades. In order here to obtain as small a spacing as possible between the flow path delimitation and the tips of the rotor blades, it is known that the rotor blade tips are designed with shrouds which clamp the rotor blades to one another in the circumferential direction. Sealing tips which extend in the circumferential direction and which, together with said ring segments, define the gap to be minimized are normally arranged on the outwardly facing surfaces of the shrouds.

In order to reduce or to avoid hot gas losses into the radially further outward rear space of ring segments, it is known for example from US 2014/0271142 to use sealing strips in mutually opposite grooves of adjacent ring segments of a sealing ring. Alternatively, DE 10 2013 205 883 A1 proposes integrally forming such sealing strips on one of the two components and thereby providing a tongue-and-groove connection, for example also between blade segments which are adjacent in the circumferential direction.

Here, it is known that the ring segments have sealing elements in the form of a honeycomb structure, also known as a honeycomb. With such ring segments, it is provided that the sealing tips facing outward on the shrouds can cut into the lamellae of the honeycomb structure in order thus to further reduce a loss of working medium.

Owing to the segmentation present in the circumferential direction, the ring segments and the sealing elements ordered thereon are generally of rectangular design, so that abutting joints can be present between two directly adjacent ring segments of a ring. In order to reduce the flow through these abutting joints, which extend parallel to the main flow direction of the working medium, these are lined up as close together as possible.

Along said abutting joints, however, it has been found that leakage flows can occur, which can reduce the efficiency of the turbine.

In addition, it is known for labyrinthine stator-rotor seals to use elements similar to the ring segments as a stator seal constituent part. At the rotor, peripheral tips are then present as a rotor seal constituent part, which tips can possibly cut into the stator seal constituent part and in particular into honeycomb structures. The stator-rotor seal is intended to reduce, or even, in the best case, to prevent, a leakage flow along the rotor, and so the same problems can arise in this usage case as in the case of the ring segments.

SUMMARY OF INVENTION

It is therefore an object of the invention to provide a sealing segment and an arrangement for outwardly delimiting a flow path of a turbine, in the case of which arrangement the leakage flow along said abutting joints is further reduced. At the same time, said arrangement should be particularly simple to produce and overall constitute a particularly durable structure.

The object on which the invention is based is achieved by a sealing segment and by an arrangement as per the features of the claims.

Advantageous configurations of the invention are specified in the dependent claims, wherein their individual features may be combined with one another arbitrarily in a claim-spanning manner. Consequently, the sealing segment may be designed in the form of a ring segment or a constituent part of a stator-rotor seal.

According to the invention, for a sealing segment for a turbine, which is able to be assembled with further such elements in a turbine to form an outer delimitation of an annular flow path of the turbine or to form a seal constituent part of a stator-rotor seal, having a plate-like wall which comprises a first side surface which, in the installed state of the sealing segment, faces the blade tips of rotor blades or the other seal constituent part, and which comprises an edge which surrounds the first side surface in a closed, peripheral manner and on which four side wall sections abut the first side surface, and having a sealing element which is arranged on the first side surface over the full surface area thereof and which, analogously to the wall, comprises four sealing side wall sections, it is provided that there are provided on at least one of those side wall sections, and/or on at least one of those sealing side wall sections, which—in the case of sealing segments assembled to form a ring in a turbine—face adjacent sealing segments of the respective ring, a number of sealing lamellae for reducing flow along the respective sealing side wall section. Furthermore, in an arrangement for outwardly delimiting a flow path of a turbine, in which a multiplicity of sealing segments according to the above embodiment are arranged so as to form an assembled ring and so as to outwardly delimit the flow path of a working medium of a turbine, or in a stator-rotor seal, the sealing lamellae of a first sealing segment bear against a side wall section or sealing side wall section of a further sealing segment, which is directly adjacent to the first sealing segment, in a pre-stressed manner. Advantageously, multiple sealing lamellae are provided per respective sealing side wall section or side wall section.

The invention is based on the realization that the flow along said abutting joint can be further reduced, and possibly even avoided, if an arrangement of sealing lamellae which at least partially impede said leakage flow is provided between directly adjacent sealing segments. In order to achieve this, there are provided on the (sealing) side wall section sealing lamellae whose ends can bear against the contact surfaces of an adjacent sealing segment in a pre-stressed manner. The sealing lamellae are advantageously fastened on one side, that is to say to merely one sealing segment. In order that their free ends constantly bear against the contact surfaces of adjacent sealing segments, said lamellae are in particular designed so as to be elastically deformable or flexible and in particular in a curved manner. In a corresponding arrangement, in the event of thermally induced expansions of the sealing segments which occur, these can make possible automatic readjustment of the sealing lamellae at the contact surfaces of the adjacent sealing segments. Consequently, it is possible for said abutting joint to be reliably sealed off for different operating temperatures. Owing to the one-sided fastening of the sealing lamellae, the assembly of the sealing segments to form an arrangement can be ensured in a manner simple and quick as before in spite of the presence of the lamella-type abutting joint seal.

According to a first advantageous configuration, the respective sealing lamellae extend transversely with respect to the flow direction of a working medium flowing in the turbine, or to a leakage flow, and in particular, relative to their installation position in a turbine, in the circumferential direction and in the radial direction. In this way, an efficient reduction of the longitudinal flow through the abutting joints is achieved.

It is furthermore advantageous for the respective sealing lamellae to project at an angle of less than 90° from planar surfaces of the respective side wall sections or sealing side wall sections. This leads to a particularly suitable elastic deformability of the lamellae when two sealing segments of the arrangement are assembled together during the assembly and in the process the sealing lamellae come into abutment with the contact surfaces of the adjacent sealing segment in a pre-stressed manner. Compression of the sealing lamellae is thus avoided.

The aforementioned effect can be further improved if, according a further advantageous configuration, the sealing lamellae are curved toward their free end.

Particularly advantageous is that configuration in which the sealing element is designed in the form of a honeycomb structure. Advantageously, the sealing lamellae are then integral parts of the sealing element such that, as viewed in the circumferential direction, said lamellae project beyond the side edge of the wall. It would alternatively also be possible for the sealing element to be designed in the form of a strippable coating system which is applied to the first side surface and has one or more layers.

According to a particularly advantageous configuration, the sealing lamellae are produced by means of an additive manufacturing method and connected to the sealing element. It would also be possible for the sealing element itself to be produced by means of the same additive manufacturing method, which would reduce the costs and the production time.

The characteristics, features and advantages of the invention described above, and the manner in which these are achieved, will be discussed in more detail in a comprehensible manner in conjunction with the following description of exemplary embodiments on the basis of the following figures. Here, the figures are illustrated merely schematically, and this in particular does not give rise to any restriction of the practicability of the invention.

Furthermore, it should be noted that all the technical features below which are provided with the same reference signs have the same technical effects.

DETAILED DESCRIPTION OF INVENTION

Figure 1:
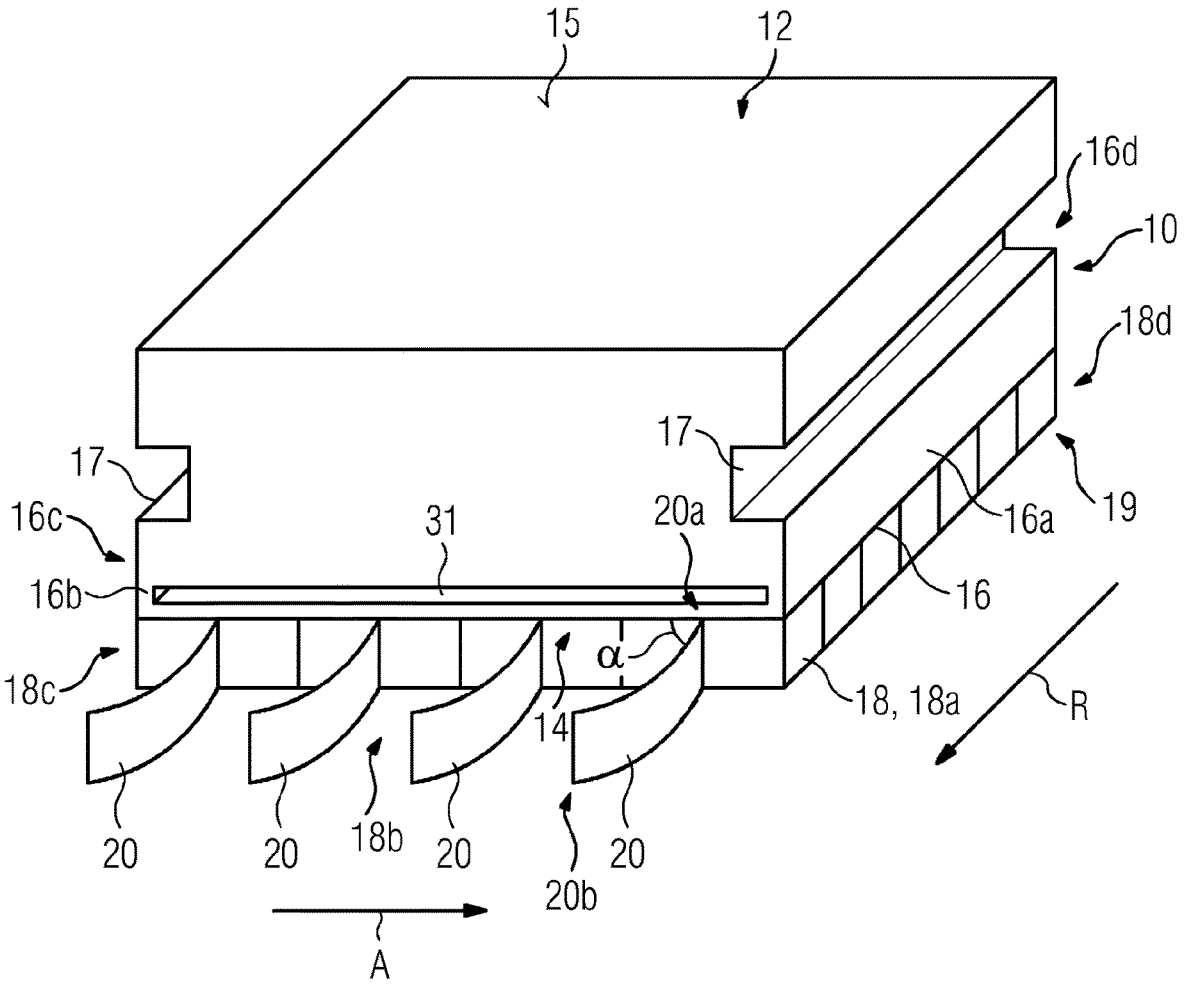
FIG. 1 shows, in a schematic illustration, an exemplary embodiment of a sealing segment according to the invention, with non-essential features for the invention not being illustrated.

FIG. 1 schematically shows, in a perspective illustration, a first exemplary embodiment of a sealing segment 10 according to the invention which is able to be assembled with further such segments in a turbine on a turbine guide vane carrier in order to seal off a gap between the segments and the rotor blades (not illustrated) of said turbine as much as possible. The sealing segments can also be assembled to form a ring which is used as a seal constituent part of a advantageously labyrinthine stator-rotor seal.

In terms of its shape, the sealing segment 10 is substantially plate-like and rectangular and comprises a corresponding wall 12 whose first side surface 14, in the installed state, faces the blade tips of rotor blades (not illustrated) or the rotor. The rotor blades may be both free-standing, that is to say shroudless, rotor blades, and shroud rotor blades. The wall 12 has a second side surface 15, which is opposite the first side surface. In the installed state, said second side surface faces the turbine guide vane carrier (not illustrated). For fastening the sealing segment 10 to the turbine guide vane carrier, grooves 17 are provided. Instead of these, it would also be possible for hooks to be provided on the second side surface 15.

The side surface 14 is surrounded by a closed peripheral edge 16. Owing to the rectangular shape of the wall 12, four side wall sections **16*a*-16*d* abut the side surface 14 on the edge 16. In the exemplary embodiment shown, in each case two side wall sections, 16*a* and 16*c* and also 16*b* and 16*d*, are parallel to one another, wherein, when the sealing segment 10 has been installed in a turbine, the pair of side wall sections 16*b*, 16*d* is arranged parallel to the throughflow direction of the working medium of the turbine or to the leakage flow. The side wall sections 16*b*, 16*d*** could also be inclined in relation to the throughflow direction of the working medium, with an angle not equal to 90° being formed. The throughflow direction is understood to mean substantially the axial direction A of the turbine.

Provided in the side walls **16*b*, 16*d* in each case are grooves 31, of which merely one is able be seen owing to the perspective illustration. In the case of sealing segments 10 assembled to form a ring, said grooves 31 are opposite one another such that conventional, plate-like seals (not illustrated) are seated therein. The abutting joints 24 present between the (sealing) side walls of adjacent sealing segments 10 can thereby be sealed off against leakage into the rear, that is to say radially outer, region of the turbine. In other words, flow through the abutting joint 24** from the inside, that is to say from the flow channel, outward, that is to say toward the turbine guide vane carrier, is consequently suppressed to the greatest extent.

Figure 2:
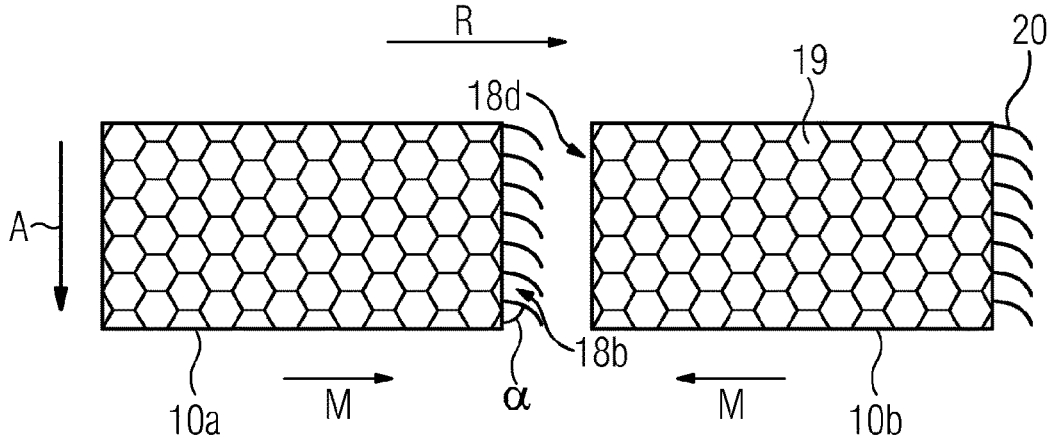
FIG. 2 shows a detail of an arrangement, for delimiting a flow path of a turbine, during assembly.

Arranged on the first side surface 14 of the wall 12 is a sealing element 18 which, according to this exemplary embodiment, is designed in the form of a honeycomb structure 19 (FIG. 2). Analogously to the wall 12, the sealing element 18 comprises four sealing side wall sections 18*a*-18*d*.

Both the side wall sections 16*a*, 16*c* and the sealing side wall sections 18*a*, 18*c* are consequently situated one behind the other with respect to the throughflow direction such that, for example, the side wall section 16*a* and the sealing side wall section 18*a* are arranged upstream of the side wall section 16*c* and the sealing side wall section 18*c*.

Provided on at least one of those side wall sections, and/or on at least one of those sealing side wall sections 18*b*, which, in the case of sealing segments assembled to form a ring in a turbine, face adjacent sealing segments of the respective ring are a number of sealing lamellae 20 for reducing flow along the respective side wall section 16*b* or sealing side wall section 18*b*. According to the exemplary embodiment illustrated in FIG. 1, four lamellae are provided. A greater number, as shown in FIG. 2 by way of example, is also advantageous.

The respective sealing lamellae 20 project at an angle α, which may be less than 90°, from planar surfaces of the sealing side wall sections 18*b* or side wall sections 16*b*. According to a first exemplary embodiment, the angle α may be 60°. Said lamellae extend so as to be curved in a leaf spring-like manner from their first end 20*a* to their free end 20*b*.

If for example the sealing element is designed in the form of a honeycomb structure, the lamellae may be part of the honeycomb structure and—as viewed in the circumferential direction—project beyond the side wall section 16*b*.

FIG. 2 shows, in a schematic illustration, a plan view of two sealing segments 10*a*, 10*b*, designed as per FIG. 1, during the assembly for forming an arrangement 22. The honeycomb structure 19 is illustrated merely schematically. During the assembly, the two directly adjacent sealing segments 10*a*, 10*b* are moved toward one another according to one of the arrows M such that the sealing lamellae 20 fastened on one side to the first sealing segment, which can be seen as sealing segment 10*a* in FIG. 2, come into abutment with the side wall section 18*d* of the adjacent sealing segment, which is referred to as sealing segment 10*b* in FIG. 2. In the operating position, illustrated in FIG. 3, the sealing lamellae 20 are elastically bent and then bear against the side wall section 18*d* of the adjacent sealing segment 10*b* in a pre-stressed manner.

Longitudinal flow through said abutting joint 24 with working medium, or with the leakage flow, in the axial direction from upstream to downstream is thus avoided to the greatest extent.

Figure 3:
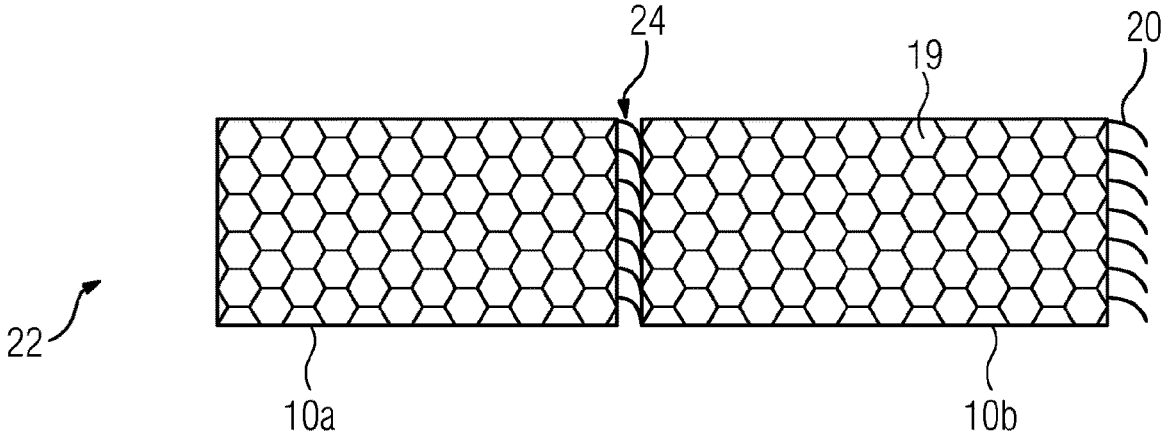
FIG. 3 shows a detail from an arrangement with two sealing segments situated in their operating position.

FIG. 3 shows the two sealing segments 10*a*, 10*b* in their operating position, in which the sealing lamellae 20 of the first sealing segment 10*a* bear against the contact surface of the second sealing segment 10*b* (sealing side wall section 18*d*) in a pre-stressed manner owing to the small spacing between the two sealing segments 10*a*, 10*b*.

The arrow R indicates the direction of rotation of the rotor blades with respect to the sealing segments 10. Here, it is an advantage if the direction of rotation is, where possible, directed from the fastened end 20*a* of the sealing lamellae 20 to the free end 20*b* thereof.

Figure 4:
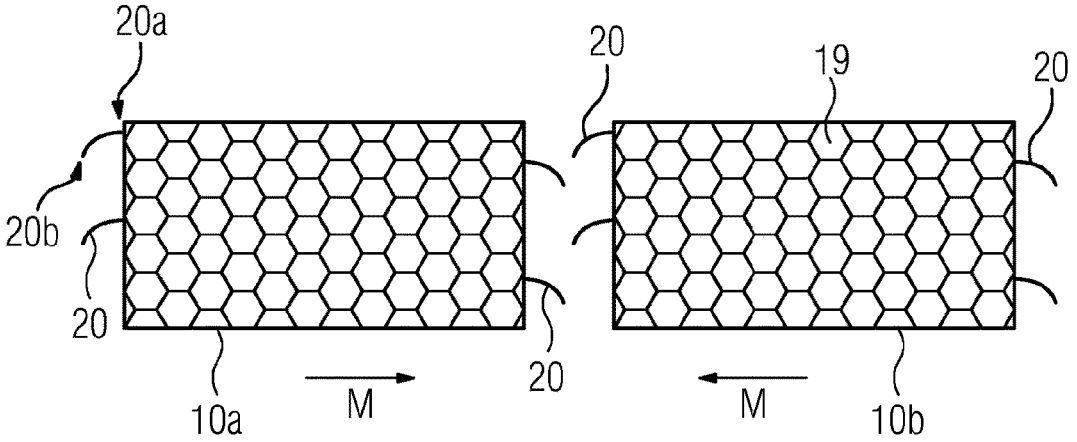
FIG. 4 shows a second exemplary embodiment, analogous to FIG. 2, with sealing lamellae on two side wall sections per sealing segment.

Alternatively, and as shown in FIG. 4, it is possible for the sealing lamellae 20, which follow one another along the abutting joint 24, to be fastened in an alternating manner to the ring segments 10*a*, 10*b* involved. In this case, sealing lamellae 20 are arranged not only on one side wall section (cf. FIG. 2, 18*b*) but on two side wall sections 18*b* and 18*d*.

Overall, the invention thus relates to a sealing segment 10 for a turbine and to an arrangement for sealing off the gaps between sealing segments 10 and rotor blades of a turbine, wherein the sealing segments comprise a plate-like wall 12 whose first side surface 14, which, in the installed state of the sealing segments, faces the blade tips of rotor blades, is surrounded by a closed peripheral edge 16 and is able to be subdivided into four side wall sections 16*a*-16*d*, and comprise, on the side surface 14, a sealing element 18 arranged over the full surface area thereof. In order to further minimize or even to prevent a local flow which possibly occurs between directly adjacent sealing segments 10, the provision on at least one of those side wall sections 16*a*-16*d*, and/or on at least one of those sealing side wall sections 18*a*-18*d*, which, in the case of sealing segments assembled to form a ring in a turbine, face adjacent sealing segments of the respective ring, of a number of sealing lamellae 20 for reducing flow along the respective side wall section is proposed.

The invention claimed is:

1. A sealing segment for a turbine, for assembly with further sealing segments in the turbine, for sealing off a gap between the sealing segments and rotor blades of the turbine or to form a seal constituent part of a stator-rotor seal, the sealing segment comprising:

a plate-like wall which comprises a first side surface which, in an installed state of the sealing segment, faces blade tips of the rotor blades or the other seal constituent part, and an edge which surrounds the first side surface in a closed, peripheral manner and on which multiple side wall sections abut the first side surface, and a sealing element which is arranged on the first side surface over a full surface area thereof and which, analogously to the plate-like wall, comprises sealing side wall sections, and a number of sealing lamellae provided on at least one of the side wall sections, and/or on at least one of the sealing side wall sections, and for sealing segments assembled to form a ring in a turbine face adjacent sealing segments of the respective ring, wherein the number of sealing lamellae are adapted for reducing flow along the respective side wall section in an axial direction from upstream to downstream, wherein the respective sealing lamellae project at an angle of less than 90° from the side wall sections or sealing side wall sections.

2. The sealing segment as claimed in claim 1, wherein the respective sealing lamellae extend transversely with respect to the flow direction of a working medium flowing in the turbine, or to a leakage flow.

3. The sealing segment as claimed in claim 2, wherein the respective sealing lamellae extend transversely with respect to the flow direction of a working medium flowing in the turbine, or to a leakage flow, and relative to their installation position in a turbine, in a circumferential direction and in a radial direction.

4. The sealing segment as claimed in claim 1, wherein the sealing lamellae are curved toward their free end.

5. The sealing segment as claimed in claim 1, wherein the sealing element is designed in the form of a honeycomb structure.

6. The sealing segment as claimed in claim 5, wherein the sealing lamellae are parts of the honeycomb structure.

7. The sealing segment as claimed in claim 1, wherein the sealing element is designed in the form of a strippable coating system having one or more layers.

8. The sealing segment as claimed in claim 1, wherein at least the sealing lamellae are produced by an additive manufacturing method.

9. An arrangement for sealing off the gaps between sealing segments and rotor blades of a turbine, comprising:

a multiplicity of sealing segments as claimed in claim 1 arranged so as to form a segmented ring, such that the sealing lamellae of a first sealing segment bear against an opposite side wall section or sealing side wall section of a further sealing segment, which is directly adjacent to the first sealing segment, in a pre-stressed manner and a longitudinal flow through the abutting joint, which joint forms between the adjacently arranged first and second sealing segments, in an axial direction from upstream to downstream is able to be avoided to the greatest extent.

10. A stator-rotor seal, comprising:

a multiplicity of sealing segments as claimed in claim 1 arranged so as to form a segmented ring, such that the sealing lamellae of a first sealing segment bear against an opposite side wall section or sealing side wall section of a further sealing segment, which is directly adjacent to the first sealing segment, in a pre-stressed manner and a longitudinal flow through the abutting joint, which joint forms between the adjacently arranged first and second sealing segments, in an axial direction from upstream to downstream is able to be avoided to the greatest extent.

* * * * *